US006899282B1

(12) United States Patent
Hill

(10) Patent No.: US 6,899,282 B1
(45) Date of Patent: May 31, 2005

(54) INJECTION SPRAYING SYSTEM

(76) Inventor: Raymond G. Hill, 213 Brocton, Victoria, TX (US) 77904

( * ) Notice: Subject to any disclaimer, the term of this patent is extended or adjusted under 35 U.S.C. 154(b) by 37 days.

(21) Appl. No.: 10/617,373

(22) Filed: Jul. 11, 2003

(51) Int. Cl.[7] ..... B05B 7/00
(52) U.S. Cl. ..... 239/61; 239/310; 417/379; 137/99
(58) Field of Search ..... 239/61, 70, 71, 239/126, 310, 307, 317; 417/2, 391, 399, 417/379; 137/99

(56) References Cited

U.S. PATENT DOCUMENTS

| | | | |
|---|---|---|---|
| 3,894,690 | A | 7/1975 | Hill |
| 4,096,059 | A | 6/1978 | Pinkerton |
| 4,390,035 | A | 6/1983 | Hill |
| 4,638,924 | A | 1/1987 | Newsom |
| 4,832,499 | A | 5/1989 | Fiorentini |
| 5,314,120 | A | 5/1994 | Nau et al. |
| 5,366,159 | A | 11/1994 | Childers |
| 6,164,924 | A | 12/2000 | Gruett et al. |
| 6,314,979 | B1 | 11/2001 | Lips |

*Primary Examiner*—David A. Scherbel
*Assistant Examiner*—Thach H. Bui
(74) *Attorney, Agent, or Firm*—Harrison & Egbert

(57) ABSTRACT

An injection spraying system for mixing additives in controlled amounts to water for spraying, which improves handling and calibrating of the concentration of the mixture. The system includes a water tank, mixing globe, pump device, unloader chamber and a worm reduction element for reducing pumping of one gallon of water into one revolution of a drive shaft. The shaft extends through a clutch device and a plurality of injection chambers. The injection chambers supply and meter the amount of additives injected. Rotation of the shaft through the injection chambers loads a set amount of additives for suction into a mixing globe. The unloader chamber controls the spraying cycle and by-pass cycle of fluid flow through the system. The present invention provides a versatile injection spraying system for multiple tasks. The types and amounts of additives sprayed can be easily adjusted without requiring adjustments to sensitive metering or measuring devices.

12 Claims, 4 Drawing Sheets

INJECTION SPRAYING SYSTEM

RELATED U.S. APPLICATIONS

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

An injection spraying system for use in agricultural applications, and more particularly, to a system for efficiently mixing additives in controlled amounts to a water as a base liquid in a liquid spraying system.

BACKGROUND OF THE INVENTION

In agricultural, nursery and gardening applications, it is a common practice to use water as a base liquid and mix into the water, various additives such as fertilizer, fungicides, pesticides or other chemicals to control pests and weeds or to otherwise produce an effect on the material being sprayed. In the application of the additives, it is important to minimize the amount of additives used and sprayed into the environment. Heretofore, there have been no reliable systems for efficiently controlling the ratio mixture of an additive with a base fluid as water, when the amount of water for a particular application has not been set. Preparation of the additive solution may result in too much solution or extra amounts of un-used additives. There is also a need to improve the handling of additives because of the hazardous nature of some chemical additives.

In the past, various patents have issued relating to spraying systems. For example, U.S. Pat. No. 6,164,924, issued on Dec. 26, 2000, to Gruett et al, teaches a piston and drive for metering a pump with a visual indicator as to the volume being dispensed. The drive assembly includes a rotatable drive shaft, an eccentric cam insert, a cam rod and a rocking beam. The rocking beam is coupled to the piston, the cam rod shaft and a biasing mechanism. When the drive shaft is rotated, movement of the cam rod shaft causes the rocking beam to pivot and move the piston along a stroke to dispense the liquid. The flow volume indicator has a main body with an annular side wall, flexible base wall, and a knobbed pointer that is inserted into a bore of the pump body and coupled to the flow adjustment stem. Movement of the flow adjustment stem causes the knobbed end of the pointer to move and the base wall to flex.

U.S. Pat. No. 4,638,924, issued on Jan. 27, 1987 to Newsom, describes a mixing and spraying system that has a premixing "globe" for the various components before dispensing. The amount of concentrate dispensed is selected by varying the pump set stroke. A meter measures the flow of water to the mix tank. A high pressure pump pressurizes mixture from the mix tank, which is discharged through a spray gun, or recycled in part to the mix tank to agitate the mixture therein.

Similarly, U.S. Pat. No. 6,314,979, issued on Nov. 13, 2001 to Lips, also teaches a mixing and spraying system utilizing a premixing "globe" for the various components before dispensing. In one embodiment, the invention includes a programmable controller and an injection assembly comprising at least one solenoid valve and an injector. The controller senses which of a plurality of watering zones is currently being watered, and effects the transmission of electrical pulses to the solenoid valve. Such pulses cause the valve to open/close and thereby produce stroking of a spring-loaded piston within the injector.

U.S. Pat. No. 5,314,120, issued on May 24, 1994 to Nau et al, discloses a mixing and spraying system having a tank for carrier fluid, such as water, and a feed pump that pumps carrier fluid from this tank through a pipe to which spray nozzles are connected, and having a metering pump that is connected by a connecting pipe to a preparation container and is driven by the carrier fluid supplied by the feed pump.

U.S. Pat. No. 4,832,499, issued on May 23, 1989 to Fiorentini, teaches an apparatus for feeding and metering fluid components to a mixing head, in particular for metering and feeding reactive chemical components to a high pressure mixing head. The apparatus comprises at least a first and second transfer cylinder whose control unit is fed with hydraulic fluid from a single source of constant pressure, and whose component pumping unit is connected to a tank for the component, respectively to an inlet aperture for the component in a chamber of the mixing head, by means of a proportional servo valve which is controlled in relation to the rate of flow of the components so as to keep both the pressure and the flow of the components to be mixed constant.

U.S. Pat. No. 5,366,159, issued on Nov. 22, 1994 to Childers, describes an automatic fertilizing apparatus which injects fertilizer directly into the waterstream of a sprinkler system. Each time the sprinkler system is activated, a predetermined amount of fertilizer is dispensed into the waterstream. The apparatus can be controlled to dispense fertilizer only through sprinkler lines as determined by the user.

U.S. Pat. No. 4,096,059, issued on Jun. 20, 1978 to Pinkerton, discloses an apparatus for accurately proportioning and mixing fluids comprising a double acting piston/cylinder unit of which the cylinder is divided into two chambers by the piston and the volume of the cylinder swept by the piston at one end of the piston is lesser than that at the other end. An inlet connection for a first fluid is made to one chamber, a conduit connects the two chambers and includes a connection to a source of the second fluid. Valve means are associated with the conduits and are effective to cause a charge of first fluid to be delivered to said one chamber and thereafter to be transferred to the other chamber drawing fluid from said source of second fluid to make up for the difference in the volumes of the chambers. Said valve means then cooperate to cause the mixed fluids to be discharged from the other chamber as said one chamber is again charged with said first fluid.

U.S. Pat. No. 3,894,690, issued on Jul. 15, 1975 to the present inventor, discloses a horticulture system that mixes and meters two liquids in precise and determinable quantities and provides appropriate control of the liquid flow. A water tank and a chemical tank are respectively coupled by constant volume pumping means to a mixing and discharge nozzle means. Bell means are provided to respond to the presence of flowing chemicals in the chemical output line to indicate that a metered volume or flow of chemicals is occurring and to provide an indication of the relative flow volume. The bypass valve includes an improved pressure responsive system which is adjustable for differing line pressure conditions.

U.S. Pat. No. 4,390,035, issued on Jun. 28, 1983 to the present inventor, also teaches a water-type spray application system employing a hydraulically-operated motor which is operated by the source of supply of the water or base carrier liquid and where the hydraulic motor dependently controls the amount of chemicals injected into the water system for application to lawns. The dependent chemical applications may be independently monitored as to the relationship of injection to the flow of water.

As disclosed in the prior art, most spraying in horticulture is performed by simple machines consisting of a water tank, a mix tank, pump, driving force, unloader, pulse cushion, discharge hose and a spray gun. Any left-over mix in the mix tank must be removed before the next spraying application. The mix tank can also be used to transport water to a location, and depending upon size, the mix tank may require a heavy truck. Some spraying systems have a second hose discharge on the mix tank.

It is an object of the present invention to provide an injection spraying system to efficiently mix chemical additives and water.

It is a further object of the present invention to provide an injection spraying system which matches a set amount of additives to be mixed with the volume of water pumped.

It is another object of the present invention to provide an injection spraying system which improves handling, monitoring and safety of chemical additives.

It is still another object of the present invention to provide an injection spraying system which reduces the need for individual calibration for each chemical additive according to the desired dilution and volume of water used.

It is still a further object of the present invention to provide an injection spraying system which can be carried on a small vehicle, such as a truck.

It is another object of the present invention to provide an injection spraying system without a mix tank.

It is a further object of the present invention to provide an injection spraying system which is ideal for tree feeding.

It is still a further object of the present invention to provide an injection spraying system which is versatile for complete multiple tasks.

These and other objects and advantages of the present invention will become apparent from a reading of the attached specification and appended claims.

BRIEF SUMMARY OF THE INVENTION

The present invention is an injection spraying system for efficiently mixing additives in controlled amounts to water for spraying, which improves handling and calibrating of the concentration of the mixture for an individual user. The system includes a water tank, a check valve in the outlet of the water tank, a mixing globe and a pump means for pressurizing water to be sprayed. The pump means has an inlet pipe connected to the mixing globe and an output conduit. The pump means is a well-known element in the prior art. The present invention importantly includes a worm gear means for reducing revolutions of the crankshaft in the known pump means to one revolution of an injector bank drive shaft for each gallon of water pumped by the pump means. Another element of the present invention is the clutch means for controlling injection of additives and a plurality of injection chambers connected to the clutch means.

Each injection chamber comprises a dipper chamber and a float valve chamber in fluid connection with the dipper chamber. The float valve chamber maintains the supply of additive in the dipper chamber. The dipper chamber measures the amount of additive to be supplied for mixing with water. A plurality of additive storage tank means supplies each float valve chamber with a particular additive, such as fertilizer. Each additive storage tank is selectively engageable to an injection chamber.

Other elements of the present invention are the unloader chamber means for controlling leakage during spraying. The unloader chamber means is placed at the output conduit of the pump means for convenient adjustment of pressure. The unloader chamber means also has fluid by-pass conduit connected to the outlet of the water tank, such that the unloader chamber means is in fluid connection with the outlet of the water tank and the mixing globe. All of the fluid output of the pump means passes through the unloader chamber means. The present invention also includes a metering gong fixed attached to the injector bank drive shaft to provide audible information for the operator, regarding the volume of fluid being dispensed. The present invention further includes a counter attached to the injector bank drive shaft which has a dial display to show the number of revolutions of the drive shaft as visual information for the operator.

The method of using the injection spraying of the present invention includes pumping water from a water tank through a check valve into a mixing globe through an outlet of the water tank by a positive displacement pump, reducing revolutions in the positive displacement pump to one revolution of an injector bank drive shaft for each gallon of water pumped, controlling injection of additives by engaging or disengaging rotation of the injector bank drive through a plurality of injection chambers by a clutch, supplying additives to the plurality of injection chambers by connecting additive storage tanks, metering additives for injection with a specific volume of additives being injected via a common injection conduit, controlling flow of water from the output conduit and additives from the common injection conduit into said mixing globe, pumping a mixture of water with a set amount of additives from the mixing globe through an unloader chamber to a pulse cushion and a discharge hose, and spraying the mixture from the discharge hose for application.

The system functions to spray a mixture of water and additives from the discharge hose. Water is pumped from the water tank, through a check valve, and to a mixing globe. The set amounts of additives from the common injection conduit are injected so as to mix a pre-determined amount of additives and water in the mixing globe. The pump pressurizes the fluid input from the mixing globe through the unloader to the discharge hose. The unloader controls the by-pass cycle of fluid flow to regulate fluid pressure. The connections and supply of additives are removable so as to make the system versatile for multiple situations, even though such situation may require different additives in different amounts.

The above and other objects, features and other advantages of the present invention will be more clearly understood from the following detailed description taken in conjunction with the accompanying drawings.

DETAILED DESCRIPTION OF THE INVENTION

Figure 1:
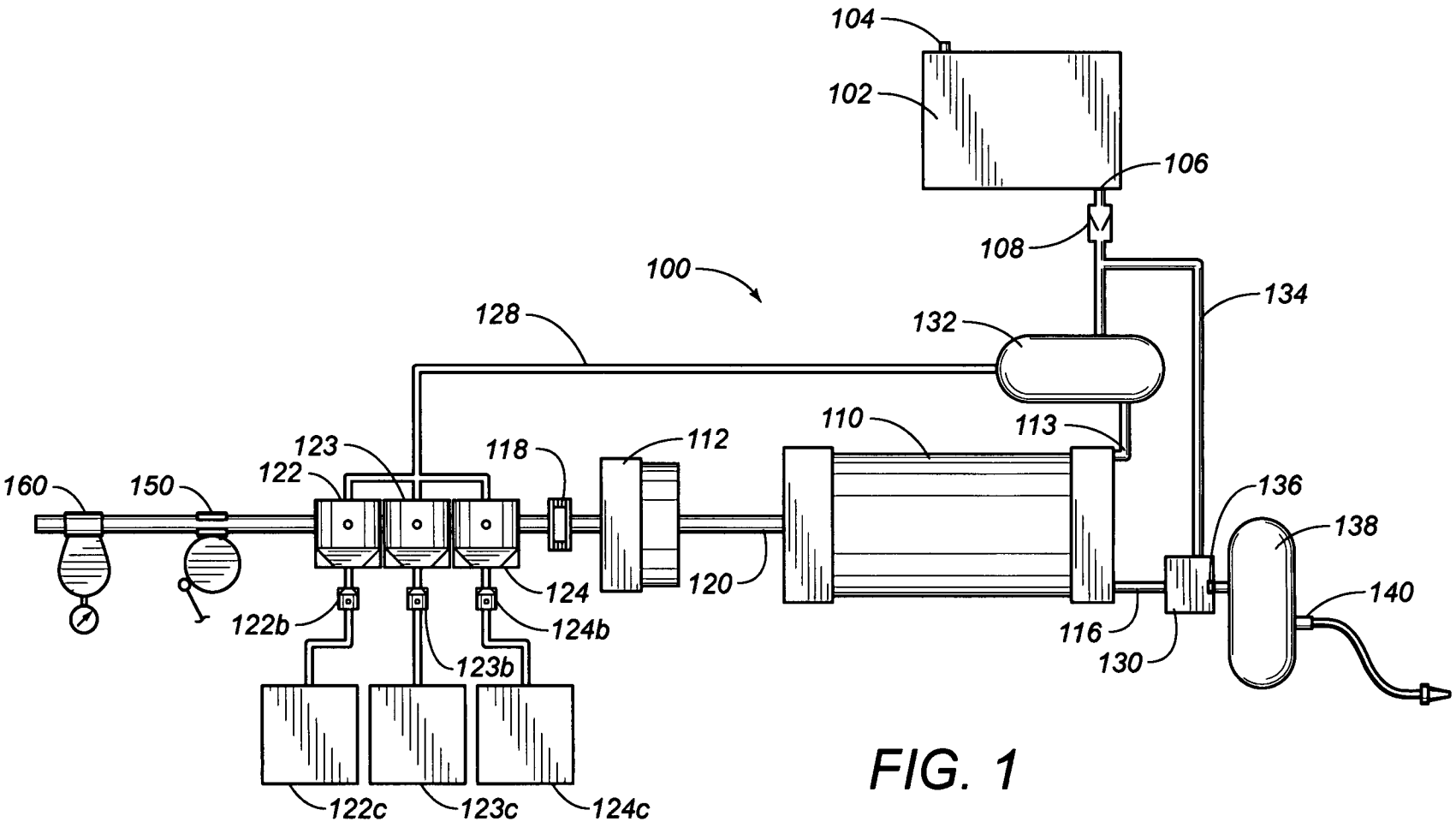
FIG. 1 is a schematic view of an injection spraying system of the present invention.

FIG. 1 shows a schematic view of the injection spraying system 100 of the present invention. The water tank 102 has an inlet 104 and an outlet 106. A check valve 108 is positioned within the outlet 106 of the water tank 102 to prevent back flow of fluid to the water tank 102. The check valve 108 has a hinged flap closing against a valve seat for a water tight seal. A mixing globe 132 is fixedly attached to the outlet 106 of the water tank 102 such that the check valve 108 is interposed between the water tank 102 and the mixing globe 132. The mixing globe 132 has a cylindrical shape so that flow of water and additives therein is tangential.

The present invention also includes a pump means 110 to pressurize water to be sprayed. The pump means 110 has an inlet pipe 113 and an output conduit 116. The inlet pipe 113 connects to the mixing globe 132 such that water flows from the water tank 102, through the check valve 108 to the mixing globe 132 and into the pump means 110. A worm gear means 112 reduces revolutions in the pump means 110 to one revolution of the injector bank drive shaft 120 for each gallon of water pumped the pump means 110. The injector bank drive shaft 120 connects to the worm gear means 112 and extends therefrom.

The injector bank drive shaft 120 is attached to a clutch means 18, which controls injection of additives. FIG. 1 also shows bank of injection chambers 122, 123, 124 connected to the clutch means 118 and having the injector bank drive shaft 120 extending therethrough. The clutch means 118 disconnects the bank of injection chambers 122, 123, 124 from rotating and injecting additives when the system 100 is not spraying. The clutch means 118 is hydraulicly operated and may be fed from the fluid from the pumping means 110 and a check valve. As pressure drops in this area when the system 100 is not spraying, the clutch means 118 is disengaged.

Each injection chamber 122, 123, 124 includes a dipper chamber 122*a*, 123*a*, 124*a*, and a float valve chamber 122*b*, 123*b*, 124*b* in fluid connection with a respective dipper chamber 122*a*, 123*a*, 124*a*. Each injection chamber 122, 123, 124 connects to a common injection conduit 128. A plurality of additive storage tank means 122*c*, 123*c*, 124*c* maintain the amount of additives in respective dipper chambers by delivering additives to each respective float valve chamber 122*b*, 123*b*, 124*b*. The additive storage tank means 122*c*, 123*c*, 124*c* are removably connected to each respective float valve chamber 122*b*, 123*b*, 124*b*. An additive delivery means for maintaining additives connects each additive storage tank means 122*c*, 123*c*, 124*c* to each float valve chamber 122*b*, 123*b*, 124*b*.

FIG. 1 also shows the unloader chamber means 130 for controlling leakage during spraying connected to the output conduit 113 of the pump means 110. The pressurized fluid mixture from said mixing globe 132 flows therethrough to be applied to the target area. The unloader chamber means 130 has a fluid by-pass conduit 134 in fluid connection with the outlet 106 of the water tank 102 between the check valve means 108 and the mixing globe 132 and an unloader valve 136 connecting to a pulse cushion 138 and a discharge hose 140. The discharge hose 140 connects to any accessory for applying the mixed additives and water to the subject which is to be treated.

FIG. 1 also shows the vacuuming additives through the common injection conduit 128. A vacuum from the pump means 110 draws injected additives through the common injection conduit 128 at all pump speeds. The slight suction is essential to the function of injection of the additives into the mixing globe 132.

Figure 2:
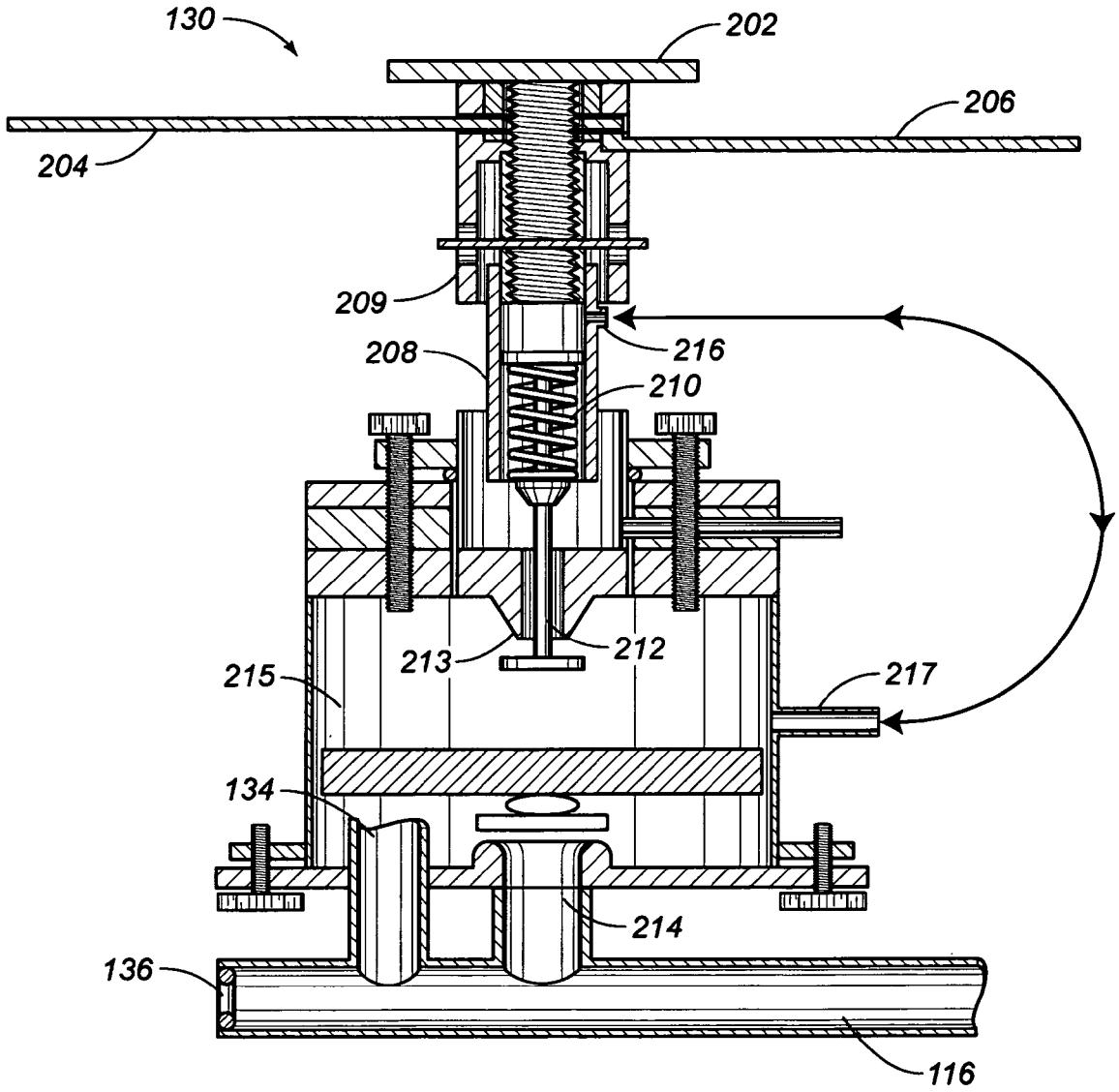
FIG. 2 is a cross-sectional view of the unloader chamber means of the present invention.

FIG. 2 shows a detailed sectional view of the unloader chamber means 130. The unloader chamber means 130 is set for a pre-determined pressure level by a pressure adjustment screw 202. When the pre-set pressure level is reached, a positive fluid "by-pass" occurs, directing fluid to the fluid by-pass conduit 134 into the mixing globe 132 and the outlet 106 of the water tank 102. During the by-pass cycle, the check valve means 108 in the outlet 106 of the water tank 102 forms a water tight seal to prevent leakage into the water tank 102. The unloader valve 136 is also closed to form a water tight seal by the closing pressure of the fluid in the pulse cushion 138 and the discharge hose 140. The pressure adjusting screw 202 has two cam levers 204 and 206 for setting the pressure level in the unloader chamber means 130. There is a pressure setting cylinder 208 having an encasing sleeve 209 with a top end thereof engaging a terminal end of the pressure adjusting screw 202. A spring 210 is longitudinally aligned with the cylinder 208 with a piston 212 extending therethrough. Tightening of the pressure adjusting screw 202 or the turning of either of the cam levers 204 and 206 lifts the encasing sleeve 209 to increase spring tension holding the valve 213 at piston 212 toward a closed position. When this valve 213 is closed, pressure trapped in the pulse cushion 138 and hose 140, acting on the piston 212, maintains the closed position. When the piston 212 opens the valve 213, the holding force is removed with the trapped fluid passing out though the piston chamber valve 217 outward of the chamber 215.

A pressure valve 214 contacts an end of the piston 212 and maintains fluid connection with a cylinder valve 216 of the pressure setting cylinder 208. The pressure valve 214 also connects to the output conduit 116 from the pump means 110. The piston chamber valve 217 feeds the chamber 215 over the piston 212. With respect to the source of operating pressure for the unloader chamber means 130, the cylinder valve 216 and the piston chamber valve 217, as indicated with arrows in FIG. 2, are powered by pressure trapped by the unloader valve 136 in the pulse cushion 138 and hose 140. A restriction in the piston chamber valve 217 reduces flow to avoid frequent recharging of trapped pressure.

Figure 3:
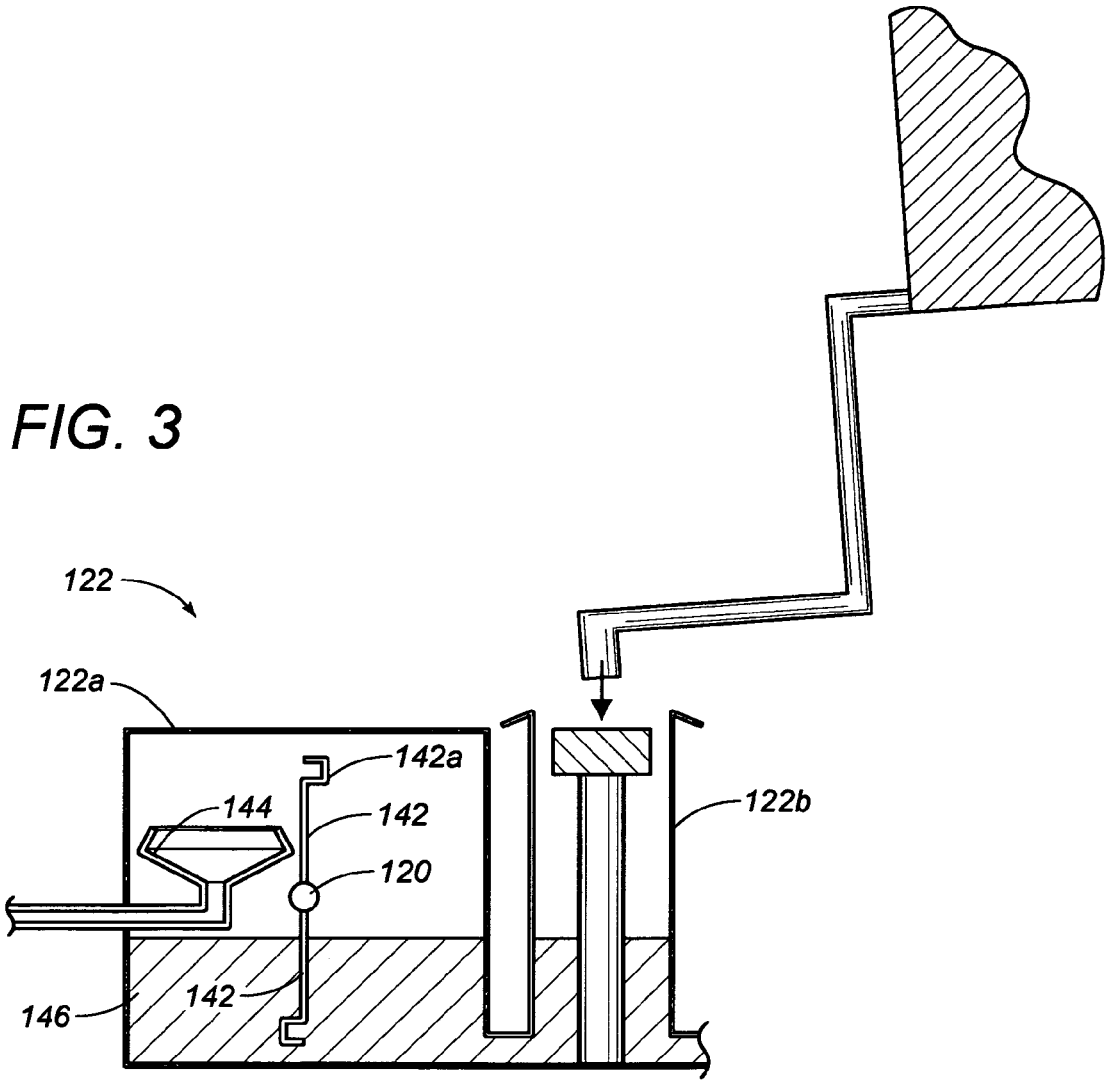
FIG. 3 is another cross-sectional view of a single injection chamber showing the respective float valve chamber, dipper chamber and additive storage tank.

FIG. 3 is a detailed sectional view of an injection chamber 122, showing the dipper chamber 122*a*, the float valve chamber 122*b* and the additive storage tank means 122*c*. The dipper chamber 122*a* of each injection chamber 122 is comprised of a plurality of dipper arms 142 radially mounted on the injector bank drive shaft 120 and a trough means 144 in a respective interior of the dipper chamber 122. The trough means 144 collects additives 146 from the plurality of dipper arms 142 as the dipper arms 142 rotate around the injector bank drive shaft 120. Each dipper arm 142 has a dipper scoop 142*a* at an end thereof with a specific volume. As can be seen in FIG. 3, the additive storage tank means 122*c* delivers additives 146 to the float valve chamber 122*b*, which maintains the supply of additive 146 in the dipper chamber 122*a*. The float valve chamber 122*b* is in fluid connection with the dipper chamber 122*a* and has a drain for returning fluid back to the additive storage tank 122*c*. The dipper arms 142 rotate through the dipper chamber and become filled with additives 146. As the rotation continues, the set amount of additives 146 in the dipper scoop 142*a* empties into the trough means 144. The dipper chamber 122*a* functions as the measuring device of the present invention because the scoops 142*a* in each injection chamber 122 have different sizes for different volumes of additives 146. The trough means 144 is in fluid connection with the common injection conduit 128. Therefore, the spring loaded damper means uses suction to draw the set volume of additives 146 for injection. Because the amount of water pumped has been set at one gallon, the concentration of additives 146 in the mixture to be sprayed is controlled by selecting the proper dipper chambers 122 and proper additive 146.

Figure 4:
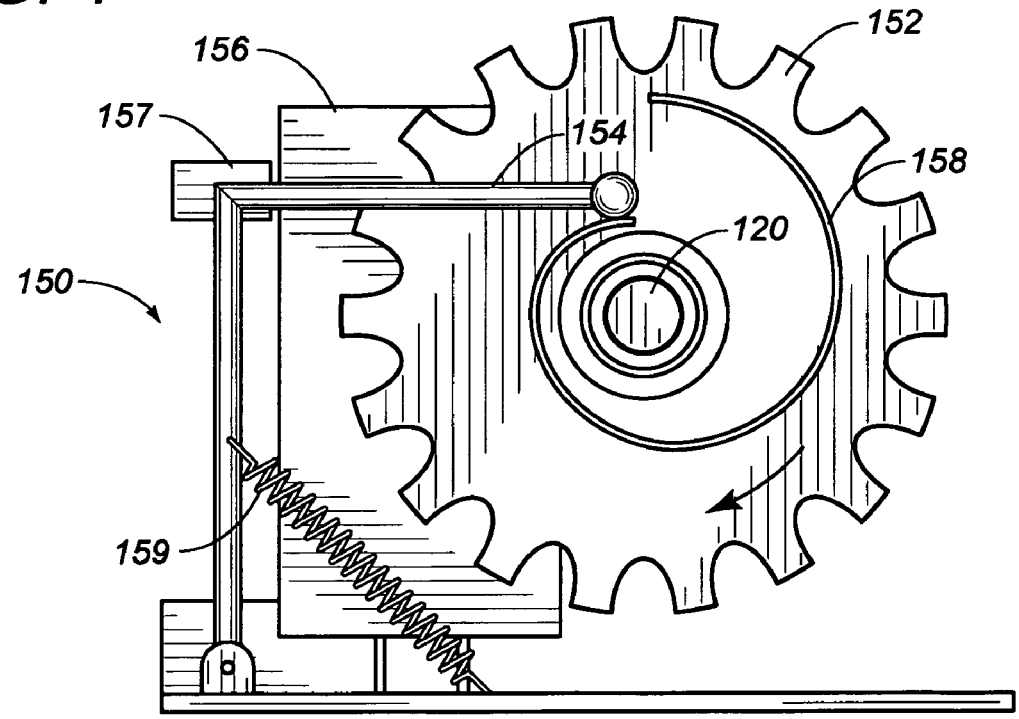
FIG. 4 is a cross-sectional view of the metering gong of the present invention.

In FIG. 4, the present invention shows a metering gong 150 comprised of a circular cam 152 fixedly mounted on the injector bank drive shaft 120, a spring loaded striker 154 extending radially from the circular cam 152, and a steel gong 156 positioned within a rotational radius of an end of the spring-loaded striker 154 such that the spring loaded striker 154 contacts the steel gong 156 upon completion of a full rotation around the injector bank drive shaft 120. As the spring loaded striker 120 is pivoted from the drive shaft 120 by a swirling rim 158, the spring 159 is cocked so that when a full revolution of the injector bank drive shaft 120 is completed, anjoint 157 of the striker 154 falls to sound the steel gong 156. Thus, the gong 156 will sound for each gallon of mix pumped. Audible information as to the volume of fluid is dispensed is provided to the operator.

The present invention further includes a revolution counter means 160 for visually displaying an amount of gallons of fluid pumped according to revolutions of the injector bank drive shaft 120. A commercial prior art revolution counter can be used in the present invention. Such counter means should be fixedly connected on the injector bank drive shaft 120 similar to the metering gong 150. The counter means may have a cam engaging a resettable dial, showing the number of revolutions, and thus, the number of gallons pumped. Any commercial counter may be used in this capacity in the present invention. Visual information as to the volume dispensed is provided to the operator.

The method of the injection spraying of the present invention provides for efficient and accurate mixing of additives with water. The method includes pumping water from a water tank through a check valve into a mixing globe through an outlet of the water tank by a positive displacement pump. A worm gear then reduces fluid flow of one gallon in the positive displacement pump to one revolution of an injector bank drive shaft. A clutch controls injection of additives by engaging or disengaging rotation of the injector bank drive through a plurality of injection chambers by a clutch. Each injection chamber is comprised of a float valve chamber and a dipper chamber.

The method further comprises supplying additives to the plurality of injection chambers by connecting additive storage tanks to a respective float valve chamber of each injection chamber and metering additives for injection by rotating the injector bank drive shaft through the dipper chamber of each injection chamber. Each dipper chamber has dipper arms with scooping ends mounted on the rotating injector bank drive shaft. Each dipper chamber contains a supply of additive to be mixed with water in the mixing globe. The float valve chamber maintains the supply of additive in the volume of the dipper chamber. Then, each dipper arm empties the additives into a trough. Every trough of the bank of injection chambers is connected to the common injection conduit. The present invention meters the amount of additives because the scooping ends transfer a set volume of additive to the trough with each rotation of the dipper arm. Each revolution of the dipper arm transfers one scoop of additive, just as each revolution occurs for one gallon of water pumped. Therefore, the operator of the present invention can control the concentration of additive by the size of the scoop.

Next, the present invention includes controlling flow of water from the output conduit and flow of additives from the common injection conduit into the mixing globe using an unloader chamber. In the spraying cycle of the present invention, a mixture of water with a set amount of additives is pumped from the mixing globe through an unloader chamber to a pulse cushion and a discharge hose. The pump inlet provides the suction to mix the water from the water tank and the additives from the common injection conduit in the mixing globe. At the pump outlet, the pulse cushion smooths turbulence in the flow of the mixture and reduces shock on the pump parts. The mixture is sprayed from the discharge hose. Any variety of prior art hoses and nozzle accessories can be used for this purpose.

In the by-pass cycle of the present invention, the unloader chamber must stop the flow of water from the output conduit and the flow of additives from the common injection conduit and activate the clutch to disengage the injection chambers. The unloader chamber means is set for a predetermined pressure level, which can be set by a pressure adjustment screw. Either of the two cam levers of the pressure adjusting screw in the unloader chamber are rotated to set a pressure level within the pressure setting cylinder by lowering the spring against the pressure valve. When the pre-set pressure level is reached, a positive fluid "by-pass" occurs, directing fluid to the fluid by-pass conduit into the mixing globe and the outlet of the water tank. As fluid pressure increases from the output conduit of the pump against the pressure valve to overcome the spring, the cylinder valve of the pressure setting cylinder releases fluid to the pressure valve to trigger the pressure valve to open the fluid by-pass conduit from the unloader chamber to the outlet of the water tank and the mixing globe.

Dropping pressure between the pump and the unloader chamber causes the check valve means in the outlet of the water tank to form a water tight seal to prevent leakage into the water tank. Dropping pressure between the pulse cushion and the discharge hose and the pump cause the unloader valve to close and form a water tight seal by the closing pressure of the fluid in the pulse cushion and the discharge hose. The plurality of injection chambers are disengaged by the hydraulic clutch when the unloader check valve and the check valve means are closed. During this by-pass cycle, the hydraulic clutch also disengages the metering gong and the counter means attached to the injector bank drive shaft.

The method of the present invention has increased versatility. The present invention can use multiple chemicals and fluids, including fertilizer, as an additive in one of the plurality of additive storage tanks. Thus, present system has the versatility to be used in spraying applications besides irrigation of plants. The plurality of additive storage tanks is removably attached to respective float valve chambers of each injection chamber to allow for quick changes of the type of additives. Also, different dipper chambers of each injection chamber are calibrated for set amounts of additives to be filled in a respective dipper chamber according to size of the scooping end of a dipper arm. The trough of each injection chamber is removably attached to the common injection conduit so as to make adjustment of the additive mixture easier. No modifications to the injection chambers are required for changing the concentration of additives in the mixing globe or for changing the additives supplied.

The present invention provides an injection spraying system to efficiently mix chemical additives and water. The system prevents waste by allowing a user to disconnect the supply of additives. There are no left over portions of additives mixed with water. The present invention allows additives to be used on an "as-needed" basis.

The present invention also provides an injection spraying system which improves handling, monitoring and safety of chemical additives. The additives can be loaded into the additive storage tank means at a central location or physical plant. By allowing centralized distribution of the additives, there is less risk of spilling and improper storage. An individual user of the injection system on a mobile rig is not required to handle the additives, which may be hazardous and toxic. Also, the amounts of additives provided to each injection system can be specifically monitored at a single location.

The injection spraying system can also be carried on a small vehicle, such as a truck. This advantage allows any source of water to be used. An individual user with the spraying system on a truck may use a customer's water, instead of hauling their own limited water. The present invention is more efficient because the system can supply additives for any amount of water, while maintaining desired concentrations of water and additives for spraying application.

Another advantage of the present injection system is the plurality of injection chambers feature. A dipper chamber of each injection chamber can be calibrated with a certain size scoop on the dipper arms, which controls the amount of additives injected into the mixing globe. Therefore, a user may change the concentration of the additives by switching injection chambers. No adjustment of the injection system is required to change the desired dilution, and the volume of water used does not require alteration.

The present invention also discloses an injection spraying system without a mix tank. The injection spraying system does not have the additional step of disposing of left-over mix in the mix tank before the next spraying application. The present invention reduces waste of materials and waste of time in mixing. Smaller and more efficient trucks and vehicles can be used with the present invention because only a water tank is required. The water tank can be small because the operator no longer needs to carry a supply of water in the water tank and mix tank and because the operator may not use the customer's water supply to fill the water tank.

The present invention is ideal for tree feeding because of the ability to use high fertilizer dilution through a virtually unlimited water supply. High dilution provides wide dispersion of the fertilizer solution in the soil mass and improved soil aeration. High dilution also allows use of low cost farm-based fertilizers without root burning. Additionally, the pressurized fertilizer solution can be injected into the soil at any desired depth so as to allow for application in or slightly below a tree's root zone so as to prevent surfacing of tree roots.

The unloader chamber means of the present invention is also a significant advantage of the prior art spraying systems. The unloader chamber of the present invention is designed for zero leakage during the spraying cycle. During the by-pass cycle, a small cylinder is used to trigger the opening of the fluid by-pass conduit and disengaging the injection chambers. Using a small pressure setting cylinder, the unloader chamber triggers positive opening of the unloader check valve without seat erosion. The small diameter of the cylinder permits use of a light pressure spring, and the two cam levers attached to the cylinder to set the pressure level make pressure setting changes easy and parts easy to replace. The unloader chamber of the present invention is a departure from prior art because the small cylinder acts as a triggering mechanism to operate the pressure valve and the by-pass cycle.

Importantly, the present invention provides a versatile injection spraying system for completing multiple tasks. The types and amounts of additives sprayed can be easily adjusted without requiring significant adjustments to sensitive metering or measuring devices. The mixture and relative ratios of additives to each other can also be efficiently adjusted with minimal re-adjustment of the present invention. Thus, present system has the versatility to be used in spraying applications besides irrigation of plants.

The present invention incorporates several inventive features in a single device for injection spraying. The present invention provides an innovative system for efficiently mixing additives and water with improved safety and control beyond what is described in the prior art.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An injection spraying system comprising:

a water tank having an inlet and an outlet;

a check valve means to prevent back flow to said water tank, said check valve means having a hinged flap closing against a valve seat and being positioned within said outlet of said water tank;

a mixing globe fixedly attached to said outlet of said water tank, said check valve means being interposed between said water tank and said mixing globe, wherein said mixing globe has a cylindrical shape; and wherein flow of water and additives therein is tangential;

a pump means for pressurizing water to be sprayed, said pump means having an inlet pipe and an output conduit; said inlet pipe being in fluid connection with said outlet of said water tank and said output conduit being in fluid connection with said unloader chamber means;

a worm gear means for reducing revolutions in said pump means to one revolution of an injector bank drive shaft for each gallon of water pumped by said pump means, said injector bank drive shaft being connected to said worm gear means and extending therefrom;

a clutch means for regulating injection of additives attached to said worm gear means;

a plurality of injection chambers connected to said clutch means and having said injector bank drive shaft extending therethrough, each injection chamber comprising:

a dipper chamber; and a float valve chamber in fluid connection with said dipper chamber, wherein each injection chamber connects to a common injection conduit;

a plurality of additive storage tank means for supplying additives respectively to each float valve chamber, said plurality of additive storage tank means being removably connected to each float valve chamber by an additive delivery means for maintaining additives in each float valve chamber; and an unloader chamber means for controlling leakage during spraying connected to said outlet of said pump means, having a fluid by-pass conduit in fluid connection with said outlet of said water tank between said check valve means and said mixing globe and an unloader valve connecting to a pulse cushion and a discharge hose.

2. The injection spraying system as claimed in claim 1, wherein said unloader chamber means is further comprised of:

a pressure adjusting screw having two cam levers;

a pressure setting cylinder having a top end engaging a terminal end of said pressure adjusting screw;

a spring longitudinally aligned with the cylinder and having a piston extending therethrough; and a pressure valve contacting an end of said piston and in fluid connection with a cylinder valve of said pressure setting cylinder, said pressure valve connecting to said output conduit from said pump means;

wherein said unloader check valve and said check valve means are closed in a water tight seal and pressure is maintained in said pulse cushion and said discharge hose when fluid passes back into said outlet of said water tank.

3. The injection spraying system as claimed in claim 1, wherein said clutch means is hydraulicly operated to disengage said plurality of injection chambers when said unloader check valve and said check valve means are closed.

4. The injection spraying system of claim 1, wherein said dipping chamber of each injection chamber is comprised of a plurality of dipper arms radially mounted on said injector bank drive shaft and a trough means in a respective interior of said dipping chamber for collecting additives from said plurality of dipper arms as said plurality of dipper arms rotate around said injector bank drive shaft; wherein said trough means of each injection chamber is in fluid connection with said common injection conduit.

5. The injection spraying system of claim 4, wherein each dipper arm has a scoop at an end thereof with a specific volume.

6. The injection spraying system of claim 1, further comprising a metering gong comprised of a circular cam fixedly mounted on said injector bank drive shaft, a spring loaded striker extending radially from said circular cam, and a steel gong positioned within a rotational radius of an end of said spring-loaded striker such that said spring loaded striker contacts said steel gong upon completion of a full rotation around said injector bank drive shaft.

7. The injection spraying system of claim 1, further comprising a revolution counter means for visually displaying an amount of gallons of fluid pumped according to revolutions of said injector bank drive shaft, said revolution counter means being fixedly connected on said injector bank drive shaft.

8. A method of injection spraying comprising:

pumping water from a water tank through a check valve into a mixing globe through an outlet of said water tank by a positive displacement pump;

reducing revolutions in said positive displacement pump to one revolution of an injector bank drive shaft for each gallon of water pumped by said pump means;

controlling injection of additives by engaging or disengaging rotation of said injector bank drive through a plurality of injection chambers by a clutch, each injection chamber being comprised of a float valve chamber and a dipper chamber;

supplying additives to said plurality of injection chambers by connecting additive storage tanks to a respective float valve chamber of each injection chamber;

metering additives for injection by rotating said injector bank drive shaft through said dipper chamber of each injection chamber such that a dipper arm, with a scooping end and mounted on said injector bank drive shaft, is filled with a specific volume of additives in said dipper chamber and such that said dipper arm spills the additives into a trough, said trough of each injection chamber being connected to a common injection conduit;

controlling flow of water from said outlet of said water tank and additives from said common injection conduit into said mixing globe; and pumping a mixture of water with a set amount of additives from said mixing globe through an unloader chamber to a pulse cushion and a discharge hose, said pulse cushion reducing turbulence of flow of said mixture; and spraying said mixture from said discharge hose.

9. The method of claim 8, wherein an additive in one of said plurality of additive storage tanks is fertilizer.

10. The method of claim 8, further comprising:

removably attaching a plurality of additive storage tanks to said float valve chamber of each injection chamber, and calibrating said dipper chamber of each injection chamber for set amounts of additives to be filled in a respective dipper chamber of each injection chamber.

11. The method of claim 8, further comprising:

attaching said trough of each injection chamber to said common injection conduit.

12. The method of claim 8, said step of controlling flow of water from said outlet of said water tank and additives from said common injection conduit into said mixing globe further comprising:

rotating either of said two cam levers of said pressure adjusting screw in said unloader chamber to set a pressure level within said pressure setting cylinder by lowering said spring against said pressure valve;

increasing fluid pressure from said output conduit of said pump against said pressure valve to overcome said spring, wherein said cylinder valve of said pressure setting cylinder releases fluid to said pressure valve to trigger said pressure valve to open said fluid by-pass conduit from said unloader chamber to said outlet of said water tank and said mixing globe, closing said check valve by dropping pressure between said pump and said unloader chamber and closing said unloader check valve by dropping pressure between said pulse cushion and said discharge hose and said pump; and disengaging said plurality of injection chambers when said unloader check valve and said check valve means are closed.

* * * * *